United States Patent [19]

Landem et al.

[11] 4,237,654

[45] Dec. 9, 1980

[54] FIRE ESCAPE WINDOW SYSTEM

[76] Inventors: Roy Landem; Michael Connolly, both of 204 Melody La., Vernon Hills, Ill. 60061

[21] Appl. No.: 927,503

[22] Filed: Jul. 24, 1978

[51] Int. Cl.[3] ..... E05B 65/10

[52] U.S. Cl. ..... 49/141; 49/164; 49/13; 182/76

[58] Field of Search ..... 49/141, 164, 163, 165, 49/13, 2; 182/76

[56] References Cited

U.S. PATENT DOCUMENTS

| | | | |
|---|---|---|---|
| 2,709,030 | 5/1955 | Vroman et al. | 182/76 X |
| 3,337,990 | 8/1967 | Iwata | 49/164 X |
| 3,818,635 | 6/1974 | Morita | 49/2 |

*Primary Examiner*—Kenneth Downey

*Attorney, Agent, or Firm*—Cook, Wetzel & Egan, Ltd.

[57] ABSTRACT

A fire escape window system has a fixed outer, peripheral frame set permanently into a window opening of a wall. An inner frame carrying sash units, screens, storm glass, and the like is mounted in the outer frame on a hinge axis. The inner frame pivots from a position weather-sealed across the outer frame to an open position where the opening in the outer frame is unobstructed for emergency personal egress. A latch retains the inner frame in a closed, sealed position but is quickly releasable for swinging of the inner frame to the open position. A spring may be used to bias the inner frame to move automatically to the open position upon release of the latch. A safety alarm signals upon opening of the inner frame. The latch may be electrically operated and, if so, it may be connected for opening the inner frame selectively in conjunction with a smoke or other fire detector which is activated by an emergency condition.

4 Claims, 6 Drawing Figures

45
12
20
11
10
15
16
45
21
32
33
38

Fig. 2
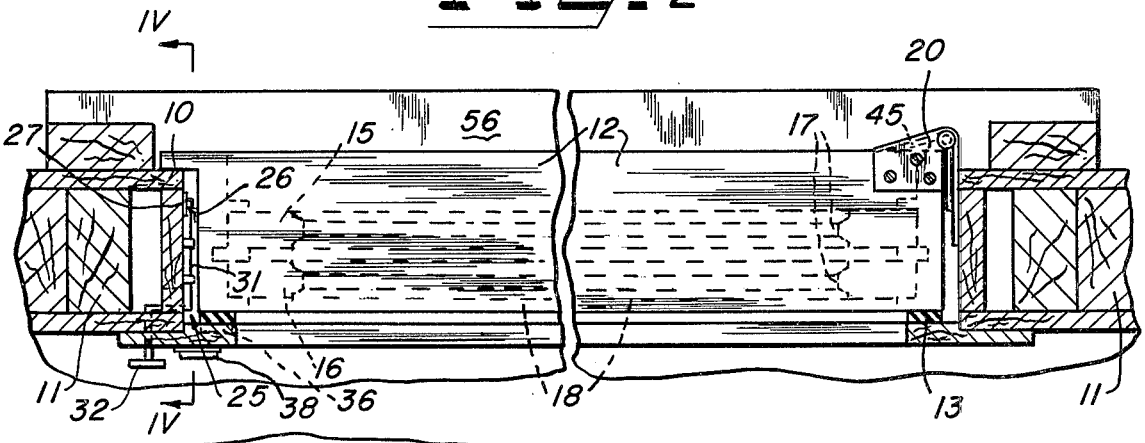
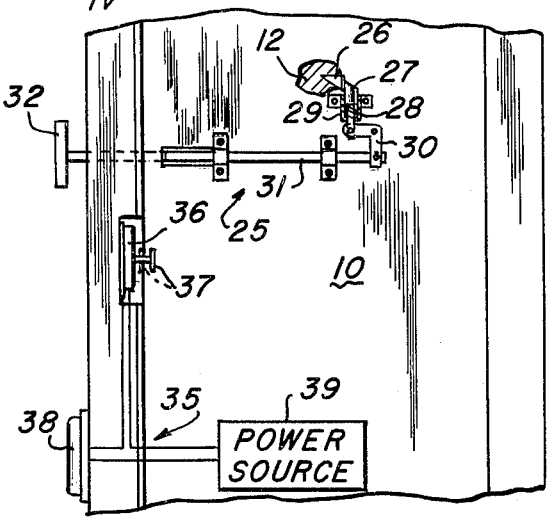
Fig. 4
Fig. 3
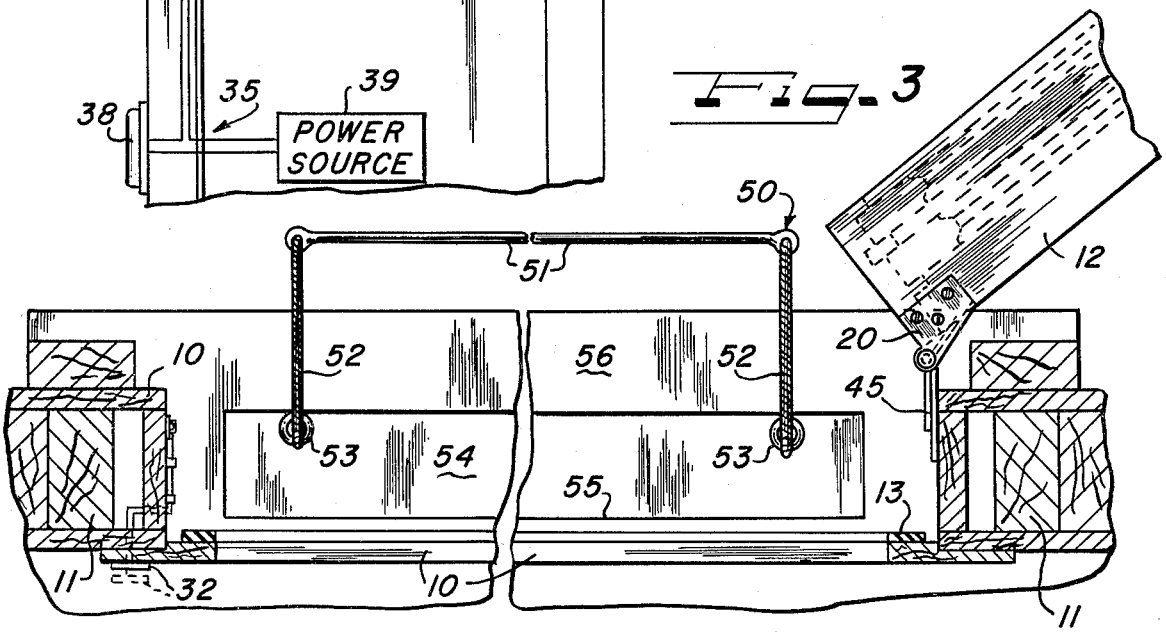
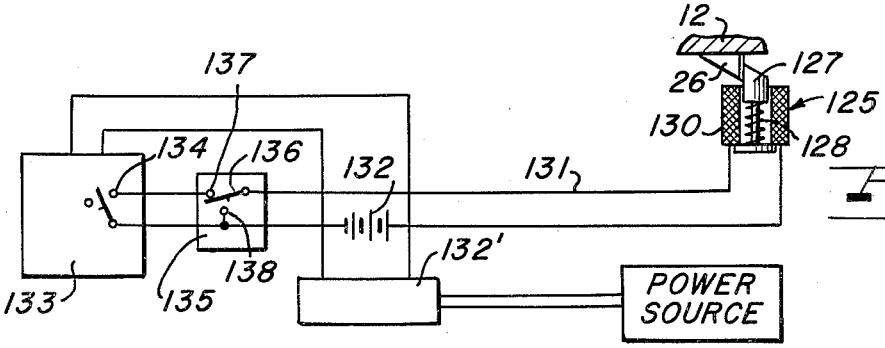
Fig. 5

112
11
20
45
10
15
16
45
21
32
33
38

FIRE ESCAPE WINDOW SYSTEM

The present invention relates to window systems and particularly to window systems having relatively moveable inner and outer frame assemblies.

Known window systems have fixed outer frames permanently set onto and sealed to walls of residential and commercial buildings. Sashes of double hung windows are carried directly on the outer frame, extending entirely across a center opening of the outer frame. One or more screens and storm units may be installed on the inside or outside of the sash units. Other types of windows are known including vertically swiveling windows with hand cranks, "French" windows opening at the center, cantilevered windows, and other forms. Most such window systems have some structure always remaining across the center opening of the outer frame. Any such structure remaining across the opening of the window in the fully opened condition, any binding or malfunctioning of the window opening apparatus, and any multiple layers of screens, storm windows, and the like, make emergency egress of persons from the windows of a room difficult or hazardous at best and fatal at worst. Small children and elderly or handicapped persons especially may either not know how to open windows or may physically not be able to operate the window opening mechanisms. Large people are also presented with peculiar difficulties in escaping through conventional windows.

In accordance with the principles of the present invention, an inner frame carrying sash or other window glass mounting arrangements, screens, and the like, is mounted in a fixed outer, peripheral frame. The inner frame is pivotable either outwardly or inwardly with respect to the building, out of the outer frame opening, quickly and easily to provide an unobstructed opening through the entirety of the outer frame opening for emergency escape through the window of all persons in case of fire or other emergency. The inner frame is sealed in weather-tight fashion to the outer frame and is latched in the closed position. An easy release device releases the latch in case of need. A biasing means such as a spring may be installed to move the inner frame clear of the outer frame automatically upon release of the latch. An alarm may be mounted on the system to sound an audible or other signal upon opening of the window, to guard against inadvertent or unauthorized opening, as by small children at play. The latch may be electrically operated, with both normal and stand-by power, to increase the ease of release. An electric latch may be connected to operate through a smoke or other fire detector. A separate control switch can then be set (1) to open the window automatically when the fire detector is actuated, (2) to enable opening only upon activation of the detector, or (3) to open the window independently of the fire detector, or any of these. The system of the present invention is applicable to any type of window; it may be fitted onto old windows with little or no change in exterior appearance, or it may be adapted to new construction.

In the drawings:

FIG. 2 is a top sectional view through the outer window frame of FIG. 1 showing the inner frame in its closed position;

FIG. 3 is a top sectional view similar to FIG. 2 but with the inner frame unit in open position and with emergency egress means dropped out the window from a storage compartment in the lower part of the outer frame;

FIG. 4 is a side plan view of the latch and alarm mechanisms, taken on line IV—IV of FIG. 2, and FIG. 5 is a schematic view of an electrically operated latch connected for actuation in conjunction with a fire detector device.

Figure 1:
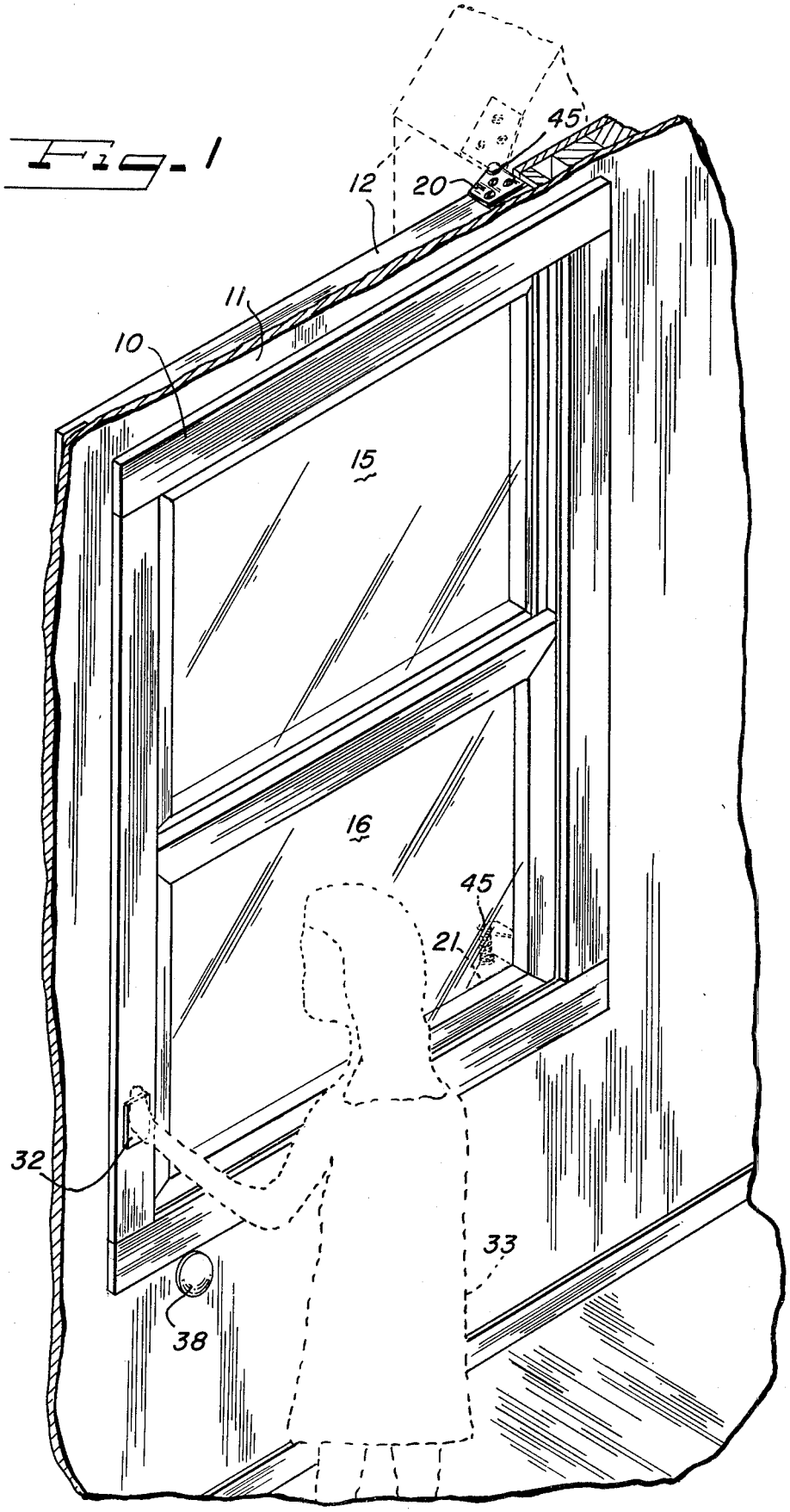
FIGS. 1 and 6 are perspective views of a window in accordance with the invention in normal and, in phantom lines, open positions.

The device of the present invention is shown in FIG. 1, comprising an outer, peripheral frame 10 mounted permanently in a window opening in a wall 11. An inner frame 12 is received within the outer frame 10 at the center opening thereof. As shown in FIG. 2, in a closed position the inner frame 12 is sealingly engaged with the outer frame 10 via a weather seal strip 13 encircling the opening in the outer frame 10. The inner frame 12 is constructed as a rigid unit in which an upper sash 15 and a lower sash 16 of a double hung window may slide on tracks 17 in a conventional manner. Other types of windows, such as French, cantilevered, cranked, or any other sort of window may be employed in place of the double hung window shown. In addition, a screen or storm window system 18 may be installed in a conventional manner upon the inside or outside of the inner frame 12 from the window glass units 15, 16, as may be practical and convenient. Such screens or storm windows 18 are not, however, to be installed upon the outer frame 10 so as to cover the window opening through the center of the outer frame 10.

As shown in FIGS. 1–3, the inner frame 12 is carried pivotably with respect to the outer frame 10 and the wall 11 upon upper and lower, vertical-axis hinges 20, 21. The portions of the hinges attached to the inner frame 12 secure the side, top and bottom members of the inner frame 12 in rigid, right-angle relationship, to avoid sagging of the unit under the cantilevered weight of the unit from the hinge pivots. Any such sagging would cause binding between the inner frame 12 and the outer frame 10.

A latch 25 is provided on an inside face of the outer frame 10 adjacent the side of the inner frame 12 opposite the hinge members 20, 21, as shown in FIGS. 2 and 4. A catch plate 26 is affixed to the inner frame 12 opposite the side carrying the hanges 20, 21. A moveable latch 27 is biased by a spring 28 into normally interfering relation with the catch 26. The latch 27 slides vertically in tracks 29 carried on or formed in the outer frame 10. A bell crank member 30 pivoted on the outer frame 10 engages the latch 27 and is itself controlled by a release bar 31 which extends to a push knob 32 located exteriorly of the wall 11 and the frame 10. Pressing upon the knob or bar 32 moves the release bar 31, rotating the bell crank 30 and withdrawing the latch 27 against the bias of the spring 28 from engagement with the catch member 26 on the inner frame 12. The inner frame 12 is then free to swing inwardly of the wall 11 from the frame 10, as shown in FIGS. 1 and 3.

Any other convenient form or arrangement of latching means known to those skilled in the art could be employed, of course, the latching arrangement shown being presently preferred but not necessarily optimum. The latch arrangement could be provided on the surfaces of the inner frame 12 and outer frame 10 inwardly of the wall 11, for instance, without departing from the principles of the present invention in any manner. Further, electrical release means could be provided, as described further below. In accordance with the invention, however, the latch and release means 25 should be easily and rapidly operable, so that even a small child 33 both can understand how to operate the latch and is physically able to do so.

Because the latch 25 is to be easily operated, even by small children, a window opening alarm 35 is also provided, for sounding a loud, audible alarm upon movement of the inner frame 12 from its latched position with respect to the outer frame 10. An electric switch 36, having normally closed contacts opened by depressing a plunger 37, is connected in series with a bell or buzzer 38 and a power source indicated schematically at 39. The sounding device 38 should be loud and piercing, so as both to discourage playing with the release latch 32 in absence of an emergency and to alert a parent or other responsible person located nearby but out of sight of the opening of the window unit 12. A disconnect switch of course could be provided in a concealed location for testing of the system, to permit communication in an emergency when the window inner frame 12 is opened properly, and for like purposes.

In order to assist in the opening of the inner frame 12 from the outer frame 10, it is preferred to provide spring bias means such as one or two coil tension springs 45 about the vertical pivot axes of the hinges 20, 21. Each such spring 45 is effective over a sufficient arc to move the inner frame 12 from the closed position of FIG. 2 to the open position of FIGS. 1 and 3, wherein the opening in the outer frame 10 is substantially unobstructed. Other biasing arrangements may be employed, including springs in different locations, beveled hinge bearing mechanisms, or other systems. Alternatively, the inner frame 12 may be manually openable, particularly if the latch and releasing mechanism 25 were provided with the release handle 32 located on the inner frame 12 so that a push on such handle would simultaneously release the latch and pivot the frame 12 from the outer frame 10 as in FIG. 1.

Where an electrical latching system 125 is provided, such as shown schematically in FIG. 5, an additional safety interlock feature is readily provided. As shown in FIG. 5, a solenoid winding 130 operates to retract a latch 127 as against the bias of a spring 128. Circuit means 131 connect the solenoid 130 to a stand-by power source 132, such as a nickel cadmium battery pack which is connected in parallel to a charging unit 132' connected in turn to a commercial power source. The circuit means 131 are connected to a smoke or other combustion products detector unit 133 having switch contacts 134 which are closed, in addition to the sounding of an audible alarm, upon the detection of combustion products. The unit 133 is conveniently powered by the same combined power source 132 and 132' which drives the solenoid 130. A further switch box 135 contains a switch arm 136 which is selectively connected "on" or "momentary on" to a pole 137. Connection as a fixed "on" contact provides automatic operation of the latch release system 125 upon detection of combustion products by the smoke detector 133. Connection to "momentary on" contact enables manually-activated release of the latch 125 only when the detector 133 is also activated. A pole contact 138 opens the inner frame 12 independently of the smoke alarm 133. A center or other "off" position of the switch arm 136 may be provided to require manual switching to open the inner frame 12.

Further in accordance with principles of the invention, where the fire escape window system of the present invention is installed in new construction, it is both feasible and desirable to provide in windows of upper stories an emergency egress means. A rope ladder 50 may for instance be used, having rungs 51 fixed at convenient distances from one another vertically and supported by ropes 52 which attach to rings 53 affixed securely to the lower part of outer frame 10, beneath the inner frame 12. A storage compartment 54 is provided in a lower portion of the outer frame 10, as in the wall 11 in cooperation with an opening 55 through a lower member of the outer frame 10. Once the inner frame 12 is pivoted to open the outer frame 10, the storage compartment is accessible and the ladder 50 or any other emergency descent system may be removed from the storage compartment 54 and flung outwardly and downwardly over a sill or other ledge 56 attached to the outside of the wall 11 and the lower part of the outer frame 10, whereby persons can descend safely to ground level. Other descent systems than a rope ladder 50 should be provided if persons unable to use such a ladder may be in the room of the window system upon occurrence of a fire. A governor-controlled motor or other device may for example be employed to control the rate of descent surely and precisely.

Figure 6:
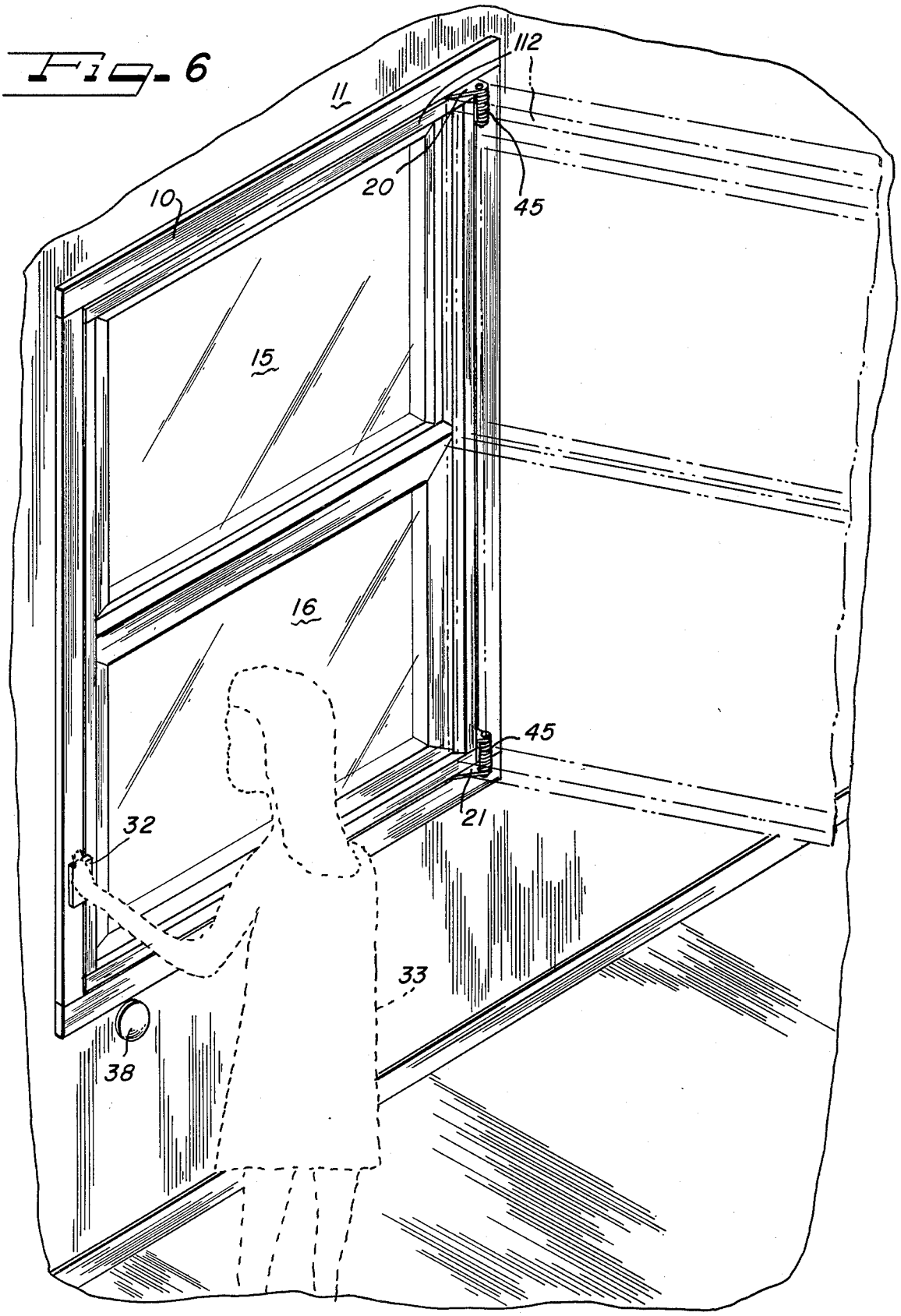

The window system may, without departing from the principles of the invention, be arranged to open the center frame 112 inwardly, as shown in FIG. 6. Such arrangement may be preferred where obstructions such as tree limbs or wires exist outside the window, where absolutely no change in exterior window appearance is desired, or for other purposes such as to enable washing of the exterior sides of the window glass. When the window opens inwardly provision must be made for draining of rain water from the lower part of the inner frame while still allowing the inner frame 112 to open past the inclined lower sill of the outer frame 10. Also, heavy furniture and other obstructions must be kept away from the wall 11 adjacent the window system to allow emergency egress as necessary. Otherwise design and use of the systems of FIGS. 1 and 6 is substantially identical.

The invention as disclosed provides a window system which does not differ in appearance in any substantial way from an ordinary window not incorporating the features of the present invention. Thus the exterior appearance of a house or other building having an emergency escape window in each room is not affected by incorporation of the present invention. Similarly, potential burglars and other intruders have no way of readily visually detecting which of the windows in the building may have the release features of the present invention. Thus, the present invention can be adapted to any style of architecture, with no decrease in security to the occupants but in fact an increase in safety as against the threat of personal harm from fires occurring in any part of the structure. The invention may be adapted to existing buildings, as well as installed in new construction.

Although several variations and modifications have been specifically described in the specification, other minor modifications may be suggested by those versed in the art. We wish to embody within the scope of the patent warranted hereon all such modifications as reasonably and properly come within the scope of our contribution to the art, as defined only by the claims granted hereon.

We claim as our invention:

1. In a window system having a peripheral outer frame fixed in a wall and having any of one or more panes of glass, screens, and the like occupying substantially the entirety of a center opening of the peripheral frame, an emergency escape apparatus for allowing unrestricted egress by quickly and easily clearing said opening through the window system, the apparatus comprising:

an inner frame received within the peripheral frame and carrying all of said glass, screens, and the like;

mounting means engaging the outer, peripheral frame and the inner frame and allowing controlled movement of the inner frame between a first position sealably engaging across the outer frame and its opening and a second position clear of the outer frame and away from said center opening;

latch means selectively engaging at least the inner frame and barring the inner frame from moving to said second position; and release means for disengaging the latch means to allow the inner frame to be moved from the outer frame to clear the opening.

2. In a window system, the emergency escape apparatus defined in claim 1, further comprising an alarm system including a switch opened by the inner frame in the first position, signal means, a power source, and circuit means connecting said power source to said signal means via said switch, whereby to actuate the signal means upon movement of the inner frame away from said first position.

3. In a window system, the emergency escape apparatus defined in claim 1, wherein the outer frame includes a storage compartment and wherein descent assistance means is stored in the compartment and is affixed to the outer frame for facilitating safe personal descent to ground level.

4. In a window system, the emergency escape apparatus defined in claim 1, further comprising spring biasing means engaging at least the inner frame for urging the inner frame from said first position toward said second position.

* * * * *